US010005572B1

(12) United States Patent
Minardi et al.

(10) Patent No.: US 10,005,572 B1
(45) Date of Patent: Jun. 26, 2018

(54) SYSTEM FOR FILLING A CONTAINER WITH DIP TUBES

(71) Applicant: TEC Engineering Corporation, Oxford, MA (US)

(72) Inventors: Maurice Minardi, Woodstock, CT (US); Jack Podgomy, Oxford, MA (US); Robert P. LaPan, Oxford, MA (US)

(73) Assignee: TEC Engineering Corporation, Oxford, MA (US)

( * ) Notice: Subject to any disclaimer, the term of this patent is extended or adjusted under 35 U.S.C. 154(b) by 714 days.

(21) Appl. No.: 13/784,019

(22) Filed: Mar. 4, 2013

Related U.S. Application Data

(60) Provisional application No. 61/607,281, filed on Mar. 6, 2012.

(51) Int. Cl.

| | |
|---|---|
| ***B65B 5/06*** | (2006.01) |
| ***B65B 19/34*** | (2006.01) |
| ***B65B 35/36*** | (2006.01) |
| ***B65B 63/00*** | (2006.01) |

(52) U.S. Cl.
CPC ..... *B65B 5/06* (2013.01); *B65B 19/34* (2013.01); *B65B 35/36* (2013.01); *B65B 63/00* (2013.01)

(58) Field of Classification Search
CPC ..... B65B 19/34; B65B 5/06; B65B 35/36; B65B 63/00; B65B 5/101; B65B 5/108; B65B 39/03; B65B 39/08; B65B 43/54
USPC ..... 53/244, 236, 248, 249, 255, 257
See application file for complete search history.

(56) References Cited

U.S. PATENT DOCUMENTS

| | | | | |
|---|---|---|---|---|
| 1,367,083 A * | 2/1921 | Otto | B65B 19/34 141/249 |
| 1,485,099 A * | 2/1924 | Wahl | B65B 19/34 141/77 |
| 2,770,351 A * | 11/1956 | Aldo | B65B 19/34 198/546 |
| 2,896,384 A * | 7/1959 | Carlsen | B65B 25/046 53/245 |

(Continued)

*Primary Examiner* — Hemant M Desai
*Assistant Examiner* — Lucas Palmer
(74) *Attorney, Agent, or Firm* — Brian M. Dingman; Dingman IP Law, PC

(57) ABSTRACT

A system for filling a container with relatively long thin tubes that are delivered on a tube conveyor. The system has a generally tubular-shaped insert with an at least partially open top and an open bottom, the insert sized and shaped to fit into the container and defining a width that is slightly larger than the length of the tubes and an insert holder that is adapted to engage the insert to hold the insert in place. There is a lift system that moves the container between an engaged position in which the container is located over the insert and a disengaged position in which the container is free from the insert, and movable clamps adapted to be moved between an engaged position in which they hold the container in position relative to the insert and a disengaged position in which the container can be moved relative to the insert. A pivot system pivots the insert holder about a pivot axis that is generally parallel to the longitudinal axes of the tubes. A flexible drape is adapted to be located at least in part in the insert and overlies tubes as they fill into the insert from the conveyor, to help keep the tubes aligned across the width of the insert.

9 Claims, 10 Drawing Sheets

(56) References Cited

U.S. PATENT DOCUMENTS 3,269,083 A * 8/1966 Marano ..... A24C 1/38 193/44
3,420,038 A * 1/1969 Crabb ..... B65B 25/046 53/245
3,492,779 A * 2/1970 Russell ..... B65B 25/046 141/1
3,618,285 A * 11/1971 Russell ..... B65B 25/046 53/437
3,633,732 A * 1/1972 Russell ..... B65B 25/046 198/575
3,695,371 A * 10/1972 Sheetz ..... B65B 1/32 177/105
3,768,231 A * 10/1973 Koslow ..... B65B 19/34 53/236
3,825,106 A * 7/1974 Wickam ..... B65G 69/165 198/358
3,932,982 A * 1/1976 Klapp ..... B65B 25/143 271/184
4,044,526 A * 8/1977 Lafleur ..... B65B 57/20 198/419.1
4,062,168 A * 12/1977 Watts ..... B65B 1/04 198/454
4,329,831 A * 5/1982 Warkentin ..... B65B 25/046 53/240
4,551,963 A * 11/1985 Nicolo ..... B65B 19/34 53/148
4,600,065 A * 7/1986 Morris ..... G01G 13/241 141/128
4,676,050 A * 6/1987 Odenthal ..... B65B 5/101 53/171
4,733,518 A * 3/1988 Griesdorn ..... B65B 19/34 53/148
4,875,327 A * 10/1989 Wilde ..... B65B 43/56 141/153
4,965,982 A * 10/1990 Jesperson ..... B65B 39/007 198/839
5,072,100 A * 12/1991 McClusky ..... B65B 25/046 235/98 A
5,108,012 A * 4/1992 Rosso ..... B65B 19/34 222/200
5,159,796 A * 11/1992 Tas ..... B65B 25/046 53/245
5,502,949 A * 4/1996 Main ..... B65B 25/046 53/245
5,542,238 A * 8/1996 Johnson ..... B65B 39/007 53/244
5,551,210 A * 9/1996 Williamson ..... B65B 1/06 53/248
5,575,134 A * 11/1996 Main ..... B65B 25/046 53/244
5,598,771 A * 2/1997 Main ..... B65B 25/046 53/244
5,921,067 A * 7/1999 Fujiwara ..... B65B 7/10 53/136.5
7,137,234 B2 * 11/2006 Caporali ..... B65B 25/143 53/249
7,475,520 B2 * 1/2009 Swider ..... B07C 3/008 198/463.3
2003/0108416 A1 * 6/2003 Schererz ..... B65B 43/54 414/794.4
2005/0229548 A1 * 10/2005 Hooper ..... B65B 5/08 53/475
2006/0191238 A1 * 8/2006 Benz ..... B65B 5/08 53/443
2008/0223000 A1 * 9/2008 Macdonald ..... B65B 5/108 53/244
2011/0167771 A1 * 7/2011 Till ..... B65B 5/061 53/475

* cited by examiner

SYSTEM FOR FILLING A CONTAINER WITH DIP TUBES

CROSS-REFERENCE TO RELATED APPLICATION

This application claims priority of Provisional Patent Application Ser. No. 61/607,281 filed on Mar. 6, 2012.

FIELD

This application relates to an electromechanical system that is used to automatically fill a box with long thin tubes.

BACKGROUND

This disclosure features a system for filling a container with long thin tubes that are delivered on a tube conveyor. The tubes can be plastic dip tubes, plastic straws or plastic sticks, for example. These tubes are typically extruded, cut to length, and then filled into cardboard boxes that have a width that is just greater than the length of the tubes. The tubes are stored and/or shipped in the cardboard boxes. To properly fill the box with the tubes, the tubes must be guided into the box in a manner that maintains their orientation across the width of the box; since the tubes are light and it is easy for the ends to catch as the tubes are moved, it is easy for one or more tubes to lose the proper orientation and end up in the box in a cross-wise fashion. If even a small number of tubes are loaded improperly in this manner the box filling process quickly becomes disorganized, and the box will not fully fill.

SUMMARY

This disclosure features a system for filling a container with long thin tubes that are delivered on a tube conveyor. The tubes can be plastic dip tubes, plastic straws or plastic sticks, for example. The system includes a generally tubular-shaped insert with an open top and an open bottom. The insert is sized and shaped to fit into the container, and defines a width that is slightly larger than the length of the tubes. There is an insert holder that engages the insert, to hold the insert in place. A lift system moves the container between an engaged position in which the container is located over the insert and a disengaged position in which the container is free from the insert. There are one or more movable clamps adapted to be moved between an engaged position in which they hold the container in position relative to the insert and a disengaged position in which the container can be moved relative to the insert. There is a pivot system that pivots the insert holder about an axis that is generally parallel to the longitudinal axes of the tubes. A flexible drape is located in part in the insert, and overlies tubes as they fill into the insert from the conveyor, to aid keeping the tubes aligned across the width of the insert.

The system may also include a movable gate that is adapted to be moved from a closed position in which it prevents tubes from moving from the conveyer into the insert and an open position in which it allows tubes to move from the conveyer into the insert. There may also be a controller that controls operation of the lift system, the clamps, the pivot system and the gate.

The system can include an input conveyor system that is constructed and arranged to move an empty container onto the lift system. There can also be an output conveyor system that is constructed and arranged to move a full container away from the lift system. Another alternative is to include a movable arm to which the drape is coupled, the movable arm constructed and arranged to be moved so as to move the drape relative to the insert. The pivot system can be constructed and arranged to oscillate or otherwise move the insert holder about the pivot axis. A controller may be used to control the oscillation. The same controller may also control the clamps, the lift system, the input conveyor system, the output conveyor system, and the movable arm.

A more specific example of the system for filling a box with relatively long thin tubes that are delivered on a tube conveyor comprises a generally rectangular tubular-shaped sheet- metal insert with an open top and an open bottom, the insert sized and shaped to fit into the box and defining a width that is slightly larger than the length of the tubes; an insert holder that is adapted to engage the insert to hold the insert in place; a lift system that moves the box between an engaged position in which the box is located over the insert and a disengaged position in which the box is free from the insert; at least two movable clamps adapted to be moved between an engaged position in which they hold the box in position relative to the insert and a disengaged position in which the box can be moved relative to the insert; a pivot system that pivots the insert holder about a pivot axis that is generally parallel to the longitudinal axes of the tubes, wherein the pivot system is constructed and arranged to oscillate the insert holder about the pivot axis; a flexible drape that is adapted to be located at least in part in the insert and overlies tubes as they fill into the insert from the conveyor, to help keep the tubes aligned across the width of the insert; a movable gate that is adapted to be moved from a closed position in which it prevents tubes from moving from the conveyer into the insert and an open position in which it allows tubes to move from the conveyer into the insert; an input conveyor system that is constructed and arranged to move an empty box onto the lift system; an output conveyor system that is constructed and arranged to move a full box away from the lift system; and a controller that controls operation of the lift system, the clamps, the oscillation of the pivot system, the gate, the input conveyor system and the output conveyor system. This system may also include a movable arm to which the drape is coupled, the movable arm constructed and arranged to be moved under control of the controller, so as to move the drape relative to the insert.

DESCRIPTION OF EXAMPLE

Figure 1:
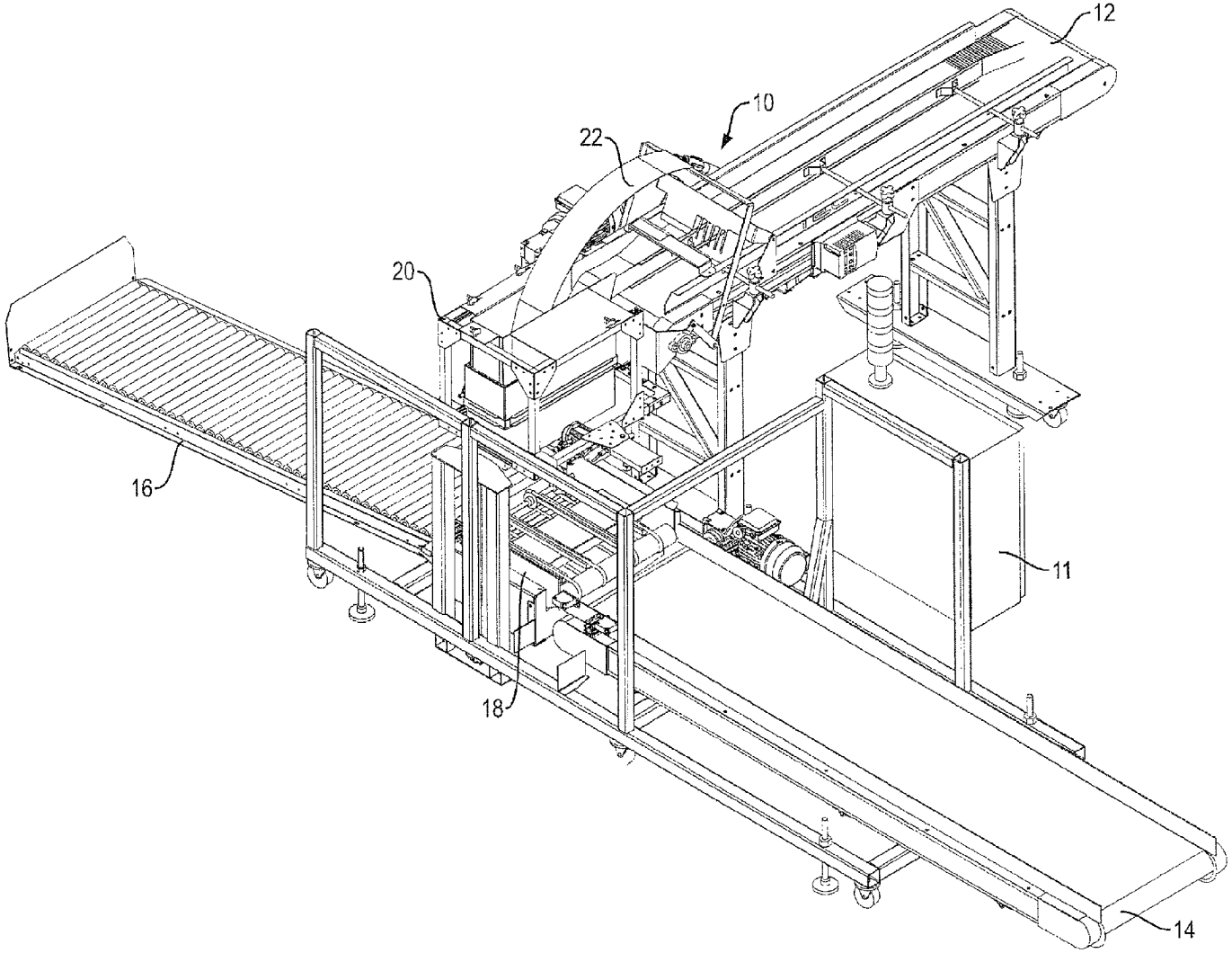
FIG. 1 is a front perspective view of a system for filling a container with long thin tubes.
Figure 2:
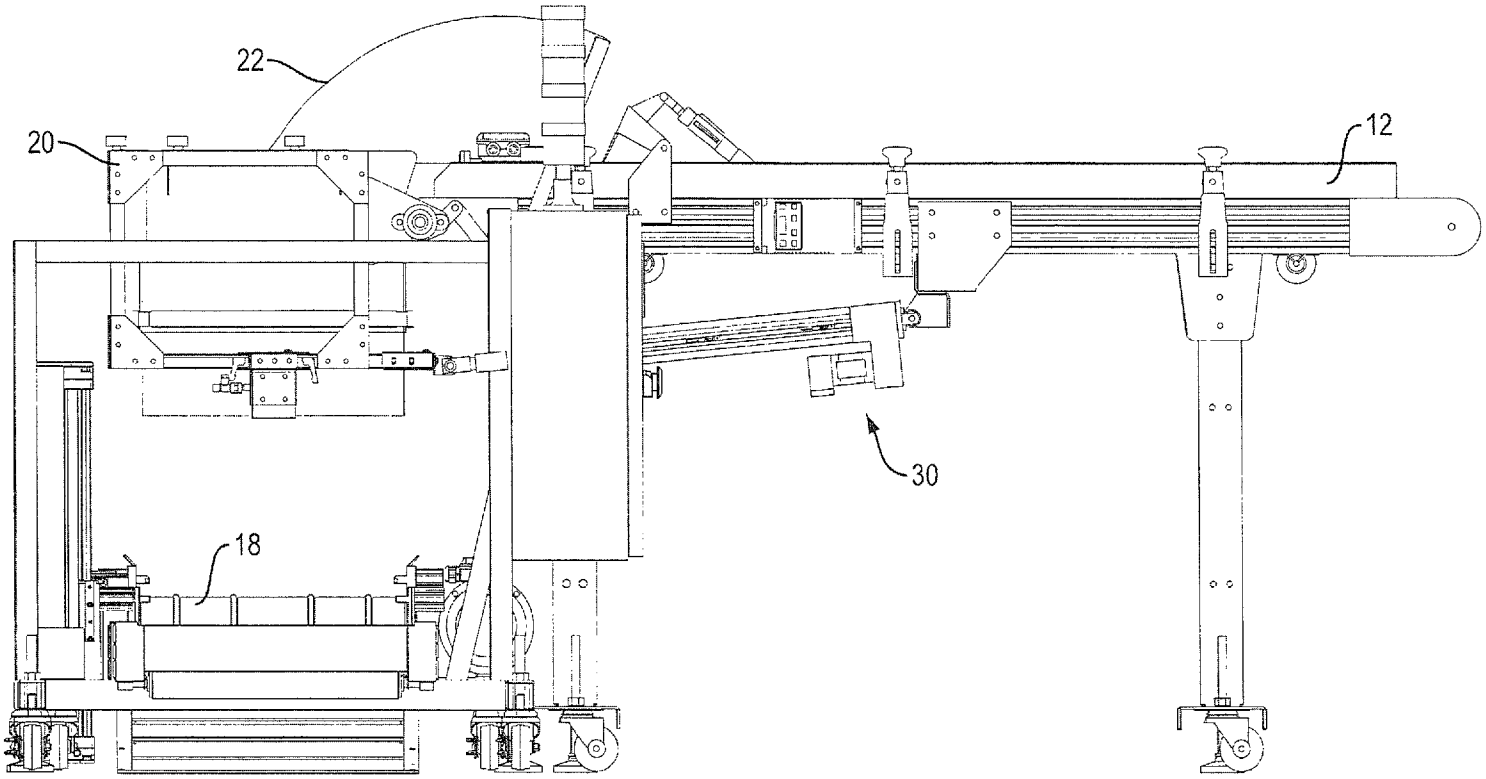
FIG. 2 is a right side view thereof.
Figure 3:
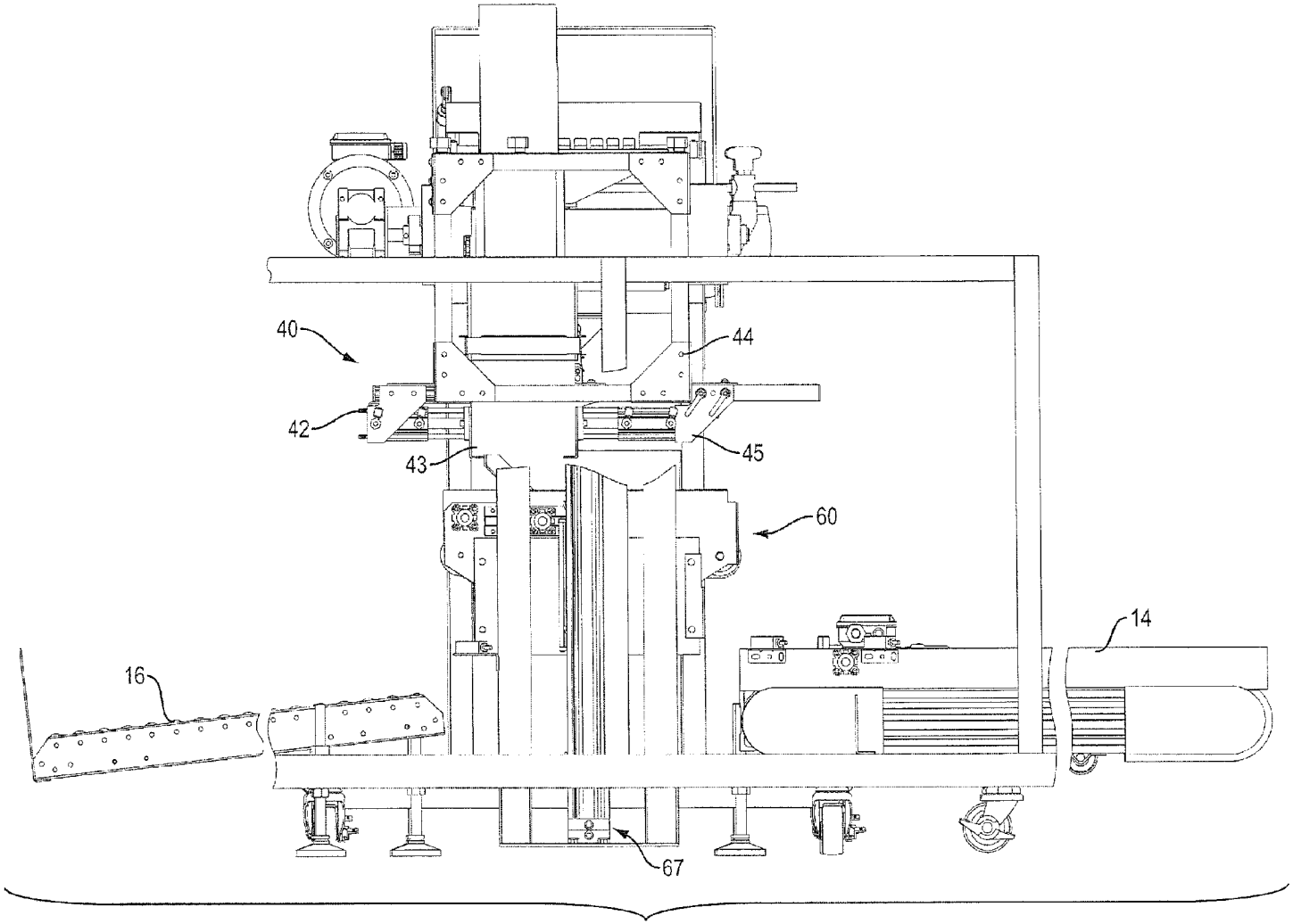
FIG. 3 is a front view thereof.
Figure 4:
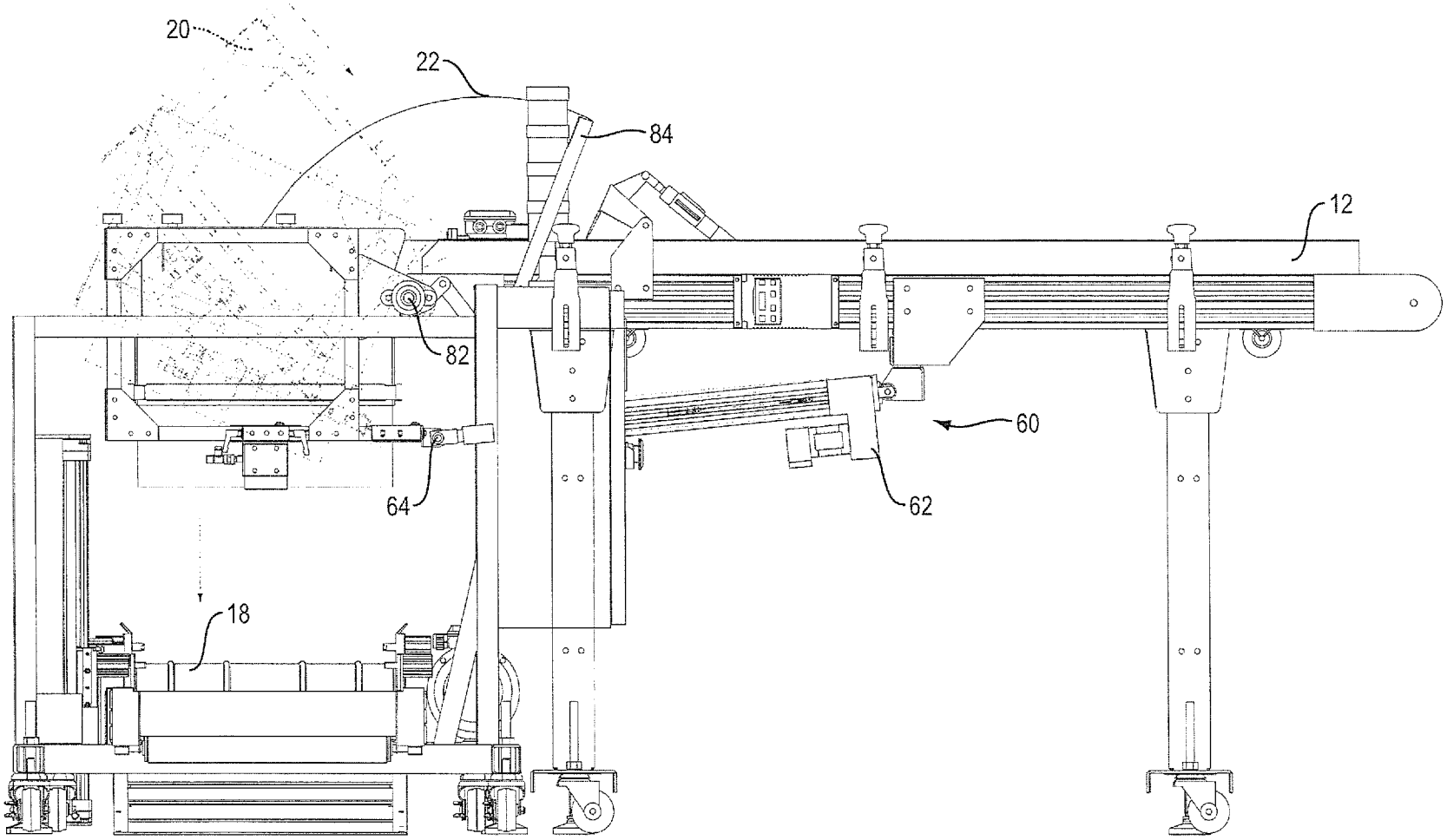
FIG. 4 is a right side view thereof illustrating various angles of the container.
Figure 5:
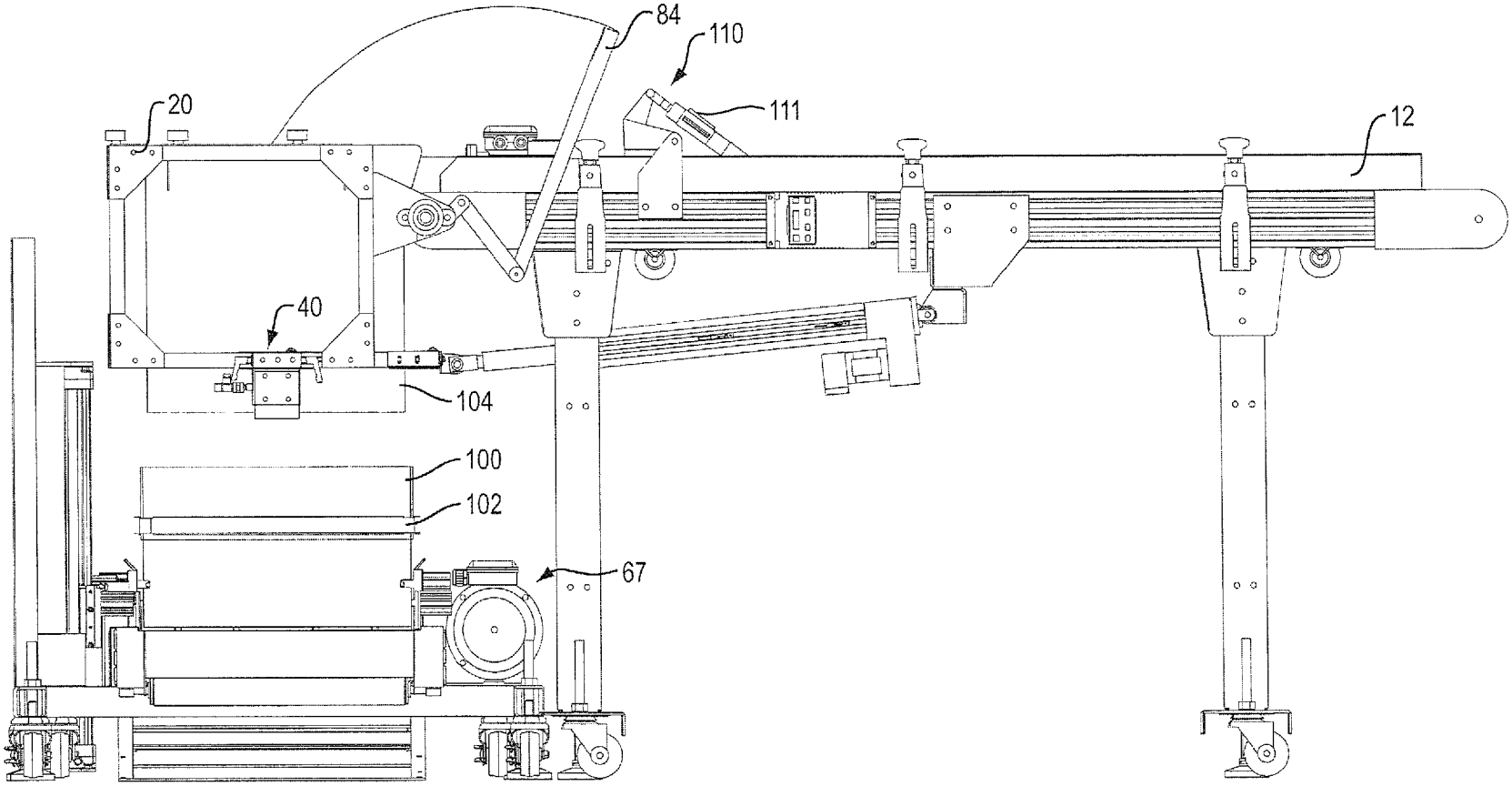
FIG. 5 shows a box ready to be loaded into the system.
Figure 6:
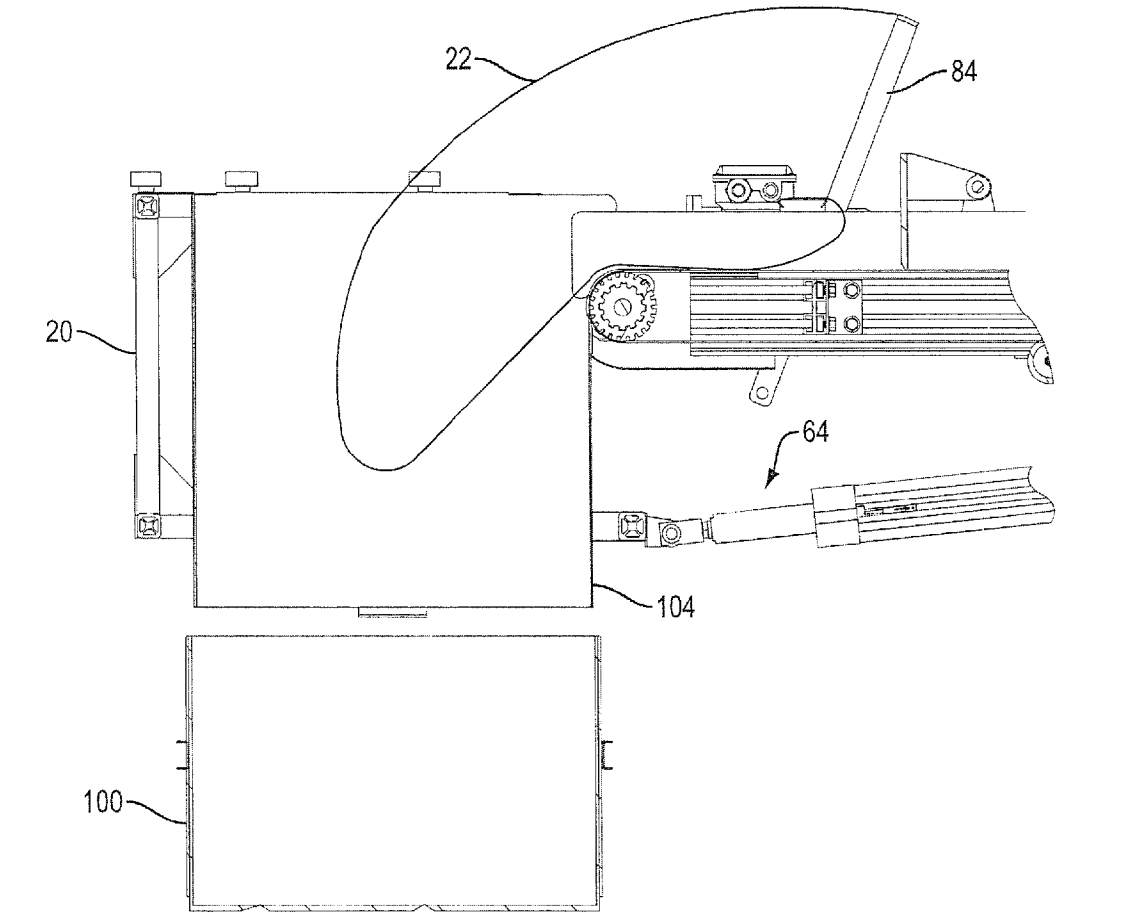
FIG. 6 shows a box about to engage with the insert.

This disclosure can be accomplished in a system for filling a container with long thin tubes that are delivered on a tube conveyor. The tubes can be plastic dip tubes, plastic straws or plastic sticks, for example. The system includes a generally tubular-shaped insert with an open top and an open bottom. The insert can be rectangular, and sized and shaped to fit into the container. The insert can have a width that is slightly larger than the length of the tubes. There is an insert holder that engages the insert, to hold the insert in place. A lift system moves the container between an engaged position in which the container is located over the insert and a disengaged position in which the container is free from the insert. There are one or more movable clamps adapted to be moved between an engaged position in which they hold the container in position relative to the insert and a disengaged position in which the container can be moved relative to the insert. There is a pivot system that pivots the insert holder about an axis that is generally parallel to the longitudinal axes of the tubes. A flexible drape is located in part in the insert, and overlies tubes as they fill into the insert from the conveyor, to aid keeping the tubes aligned across the width of the insert.

One non-limiting example of the system for filling a container with long thin tubes that are delivered on a tube conveyor is shown in FIGS. 1 through 10. System 10 is used to fill container or box 100 with long thin tubes such as dip tubes or straws. Such tubes are typically made from extruded plastic profiles, and are from 4" to 12" long and from ⅛" to 2" in diameter. Such tubes or profiles are typically created through extrusion. The extrusion process includes a tube profile cutter that cuts the extruded tube to the right length. A conveyor then transports the tubes from the cutter in a manner in which the longitudinal axes of the tubes are orthogonal to the direction of travel.

These tubes are typically shipped in cardboard boxes that have a width that is just greater than the length of the tubes. To properly fill such a box, the tubes must be guided into the box in a manner that maintains their orientation across the width of the box; since the tubes are light and it is easy for the ends to catch as the tubes are moved, it is easy for one or more tubes to lose the proper orientation and end up in the box in a cross-wise fashion. If even a small number of tubes are loaded improperly in this manner, the box filling process quickly becomes disorganized and improper.

Tubes are transported cross-wise by conveyor 12 (i.e., their long axes are perpendicular to the direction of travel of the conveyor) and filled into container 100, which is typically a cardboard box. In the box has flaps, the flaps can be folded back and held in place as the box is being filled, The flaps can be held by a retainer (e.g., a strap) 102 that fits around the box. Or, a thin plastic bag can be placed into the box and folded over the flaps to keep the top of the box open. Conveyor 12 can be adjustable in width to accommodate tubes of different lengths.

An empty box is moved into a position to be filled via power conveyor 14. The empty box enters lift station 18 that includes a power roller that places the box in the proper position and orientation to be lifted over the insert. The lift station is raised by powered lift conveyor 60 that includes conveyor lift 67 that can comprise a pneumatic cylinder. All of the operations of system 10 are controlled via system controller 11. When a box has been filled, it is lowered, and moved away by power roller 18 to box exit gravity roller conveyor 16.

Figure 10:
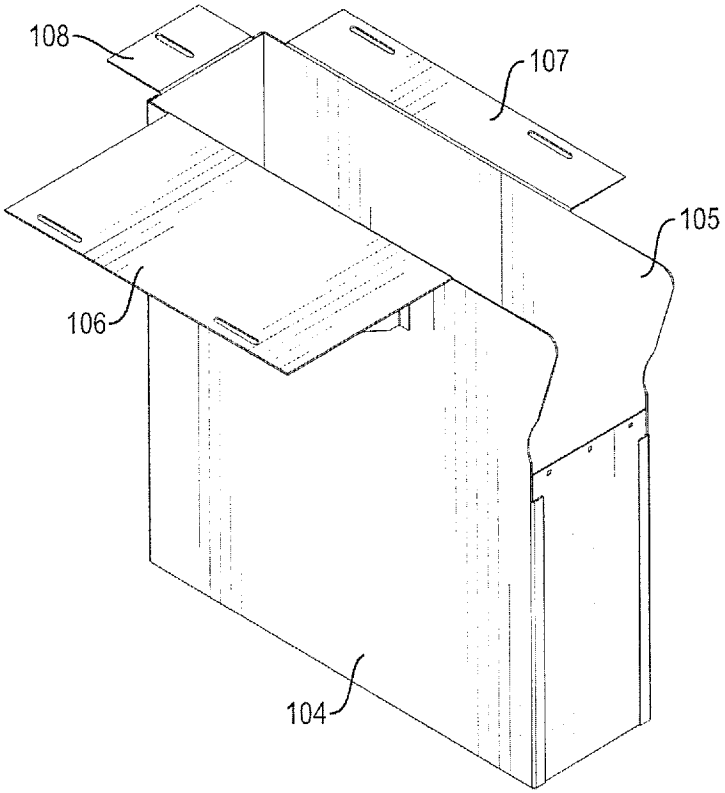
FIG. 10 shows the insert.

A rigid (e.g., sheet metal) insert or cartridge 104 (essentially, a metal rectangular tube that is open at both ends; open top 105 of insert 104 shown in FIG. 10) is used to help orient and guide the tubes as they are filled into the box. Tubes in the box are indicated in the drawings by number 130. Also, insert 104 is removably held in insert holder or cage 20. This can be accomplished using thumbscrews (not shown) that are received in slots in horizontal insert extensions 106-108. The insert has outside dimensions that are just smaller than the inside dimensions of the box being filled with tubes so that the box can fit over the outside of the insert. Different inserts are used for different size tubes. Inserts are interchangeable within the same cage for tube lengths of 4" to 10".

An empty box is lifted by the lift station onto the insert. Clamping system 40 is then engaged to hold the box in place relative to cage 20. System 40 comprises actuators 42 and 44 that move clamps 43 and 45 into and out of engagement with the box; the clamps are typically "L"-shaped supports that lie against both the sides and bottom of the box (on opposite sides of the box) to hold the box in place relative to the insert and thus relative to the cage. System 40 is mechanically coupled to the cage so that the proper orientation of the box is maintained.

While a full box is being removed and a new empty box is being placed, gate system 110 is enabled to block the movement of straws/tubes along conveyor 12. Gate system 110 can include a plate that in the closed position is held close to the surface of the conveyer at right angles to it, to block tubes from moving past the plate. The plate is coupled to a controlled pneumatic cylinder 111 that is adapted to lift the gate away from the conveyor surface to open the gate, and also move it back close to the conveyor surface to close the gate. The straws will back-up behind this movable gate when the gate is closed. When the empty box is in place ready to be filled, the gate is lifted to allow the straws to again be moved into the box. In one non- limiting embodiment the gate can be lifted a distance just greater than the diameter of one straw and less than twice the diameter, such that only one straw at a time can move past the gate; this meters the straws into the box. Such metering is typically not needed, as the drape system itself acts to buffer the movement of the straws into the box and keep the straws aligned across the width of the box. The tubes then move down the conveyor and fall into the box. At high production rates of say 800-1,000 tubes per minute it might be helpful to add a second gate to dam the product during the box change operation.

Figure 7:
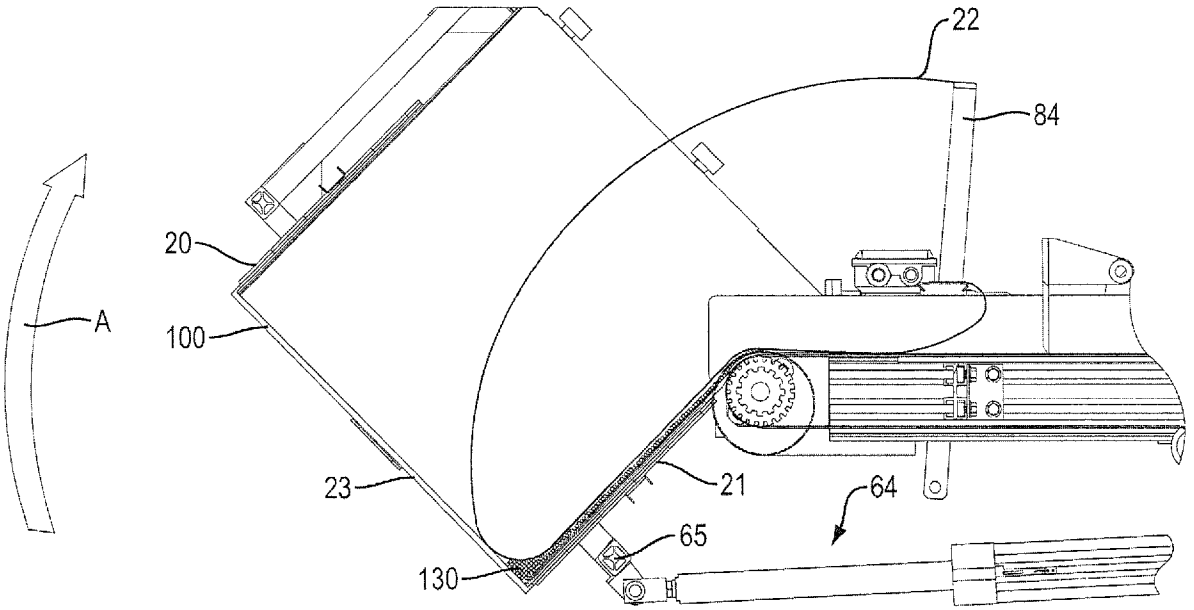
FIG. 7 shows the box as it is just beginning to be filled.

Once an empty box is clamped to the cartridge, cage 20 is pivoted up to about forty-five degrees from the horizontal, to the position shown in FIG. 7. Insert holder or cage 20 pivots about pivot axis 82 that is generally parallel to the longitudinal axes of the straws. Pivoting is accomplished with cage pivoting system 30 that includes ball screw actuator 62 that moves pivot link 64. Cage extension 65 is coupled to pivot link 64 to accomplish the pivoting of cage 20. The gate is lifted and straws then begin to enter the container along angled container sidewall 21 and fall or roll towards container bottom 23.

Figure 8:
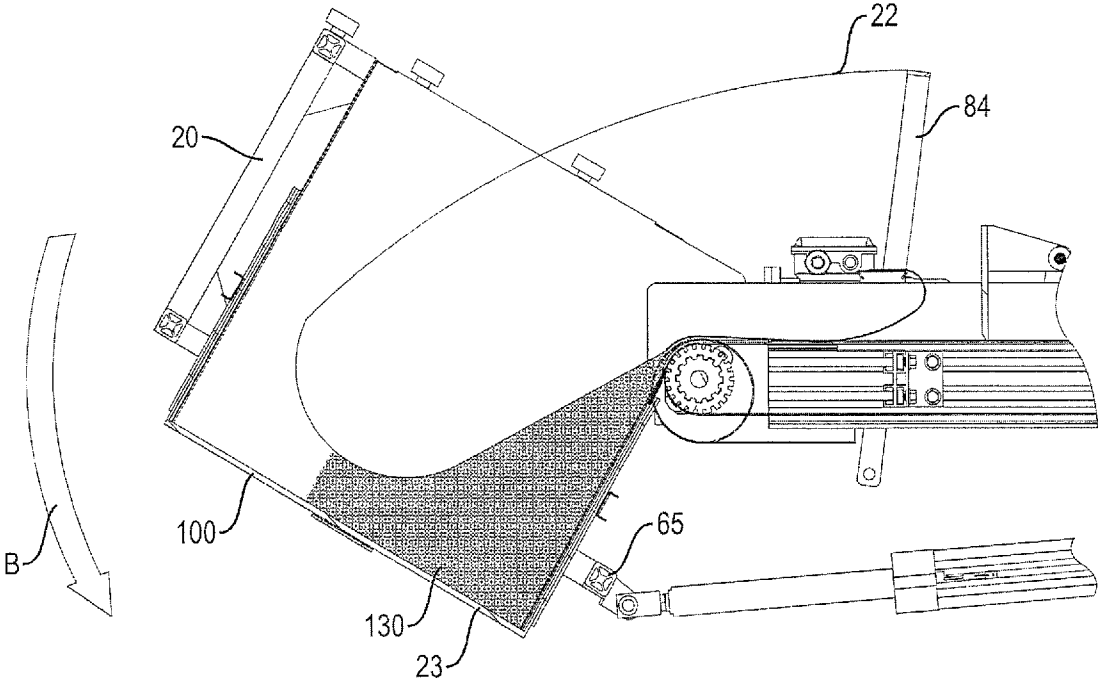
FIG. 8 shows the same box partially filled.

To help maintain the straws in the proper orientation in which their longitudinal axes are parallel to the width of the box, a flexible drape or strap system 22 is automatically placed into the insert, and generally lying against wall 21. This is accomplished with one or more flexible drapes 22 that can be made from a light weight polyurethane material. The drape keeps the straws from tumbling into the box and also pushes them slightly downward via friction and the weight of the fabric so that no more than several straws at a time can move down along the angled box sidewall and into the bottom of the box. Drape 22 can be but need not be movable relative to the box. This can be accomplished by coupling the drape to movable arm 84 that moves from an engaged position shown in FIG. 7 to a disengaged position shown in FIG. 9. Strap 22 places a light weight against the straws that is sufficient to keep them from bouncing or otherwise moving out of position but is light enough to allow the straws to move by gravity down wall 21 and accumulate along bottom 23. To facilitate proper orderly filling, cage 20 can be slowly pivoted up and down slightly (i.e., slightly oscillated) in the direction of arrows A and B via actuator 62 and pivot link 64. This pivoting motion and the resulting changing orientation of the container jogs the straws so that they fill across bottom 23 as shown in FIG. 8. Also, as the box is filled (which is known via the count of straws received from the straw extruder) the box is incrementally pivoted more and more upright so that the box can be filled close to the top without straws spilling out over an angled lip. The full range of pivoting of the cage is shown by the series of phantom cage locations in FIG. 4.

Figure 9:
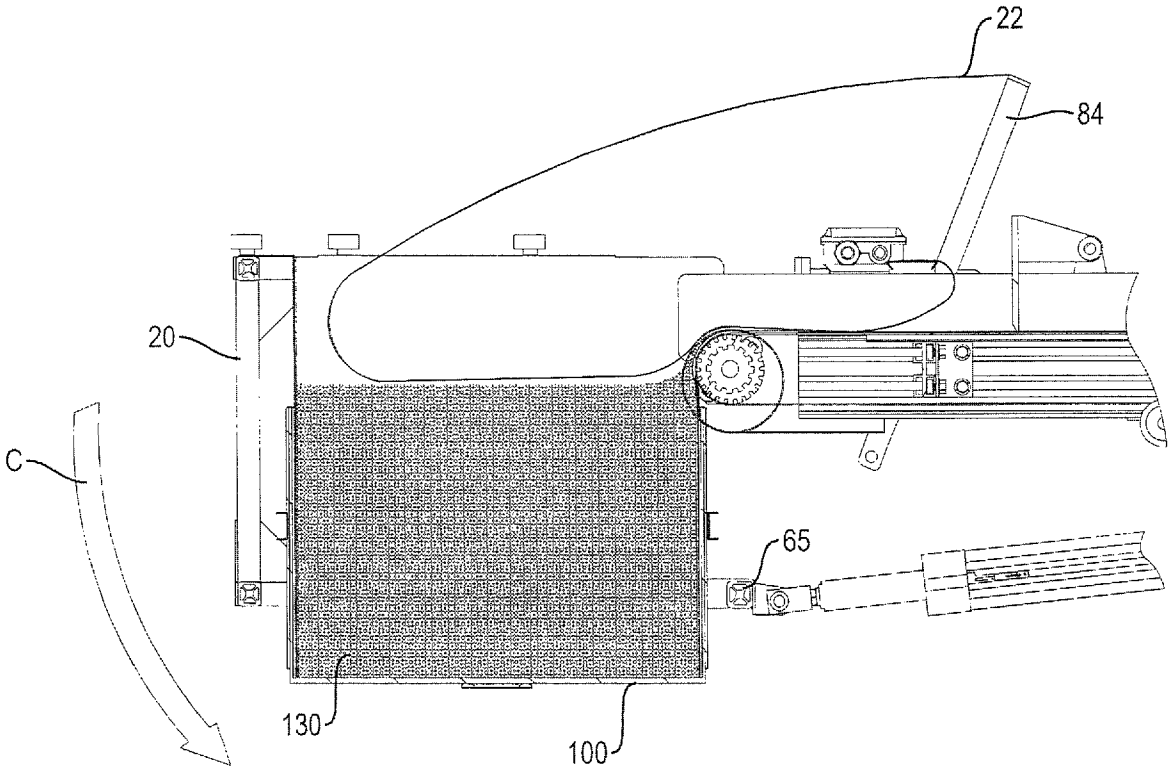
FIG. 9 shows the same box after it has been filled.

When the box is sufficiently filled as indicated by the count of straws provided by the tube cutter used at the extruder, gate 110 is closed and the box is moved back to a fully horizontal position in the direction of arrow C, FIG. 9. When it is used, arm 84 also moves backward to partially withdraw the strap from the box. The box is then unclamped, and the lift moves it back down onto conveyor 18 which mows it onto exit conveyor 16. The process can then be repeated.

Although details are shown in certain drawings they are not necessarily a limitation of the invention, as the invention can be accomplished in other manners.

What is claimed is:

1. A system for filling a container that has a bottom with relatively long thin tubes that are delivered on a tube conveyor, wherein the tubes lie across the conveyor such that their longitudinal axes are transverse to a direction of motion of the conveyor, the system comprising:

a generally tubular-shaped insert with an at least partially open top and an open bottom, the insert sized and shaped to fit into the container and defining a width that is slightly larger than the length of the tubes;

an insert holder that is adapted to engage the insert to hold the insert in place;

a lift system that moves the container between an engaged position in which the container is located over the insert and a disengaged position in which the container is free from the insert;

one or more movable clamps adapted to be moved between an engaged position in which they hold the container in position relative to the insert and a disengaged position in which the container can be disengaged from the insert;

a pivot system that pivots the engaged insert holder and container together about a pivot axis that is generally parallel to the longitudinal axes of the tubes, wherein the pivot system holds the container such that its bottom is angled from horizontal as it begins being filled with tubes, and incrementally pivots the container more upright, with its bottom closer and closer to horizontal, as the container is filled;

a flexible drape wherein the drape is overlying and in contact with the tubes at least in part while they are on the conveyor, and at least in part while they are in the insert, to help keep the tubes aligned as they fill from the conveyor and across the width of, and into, the insert; and a movable arm to which the drape is fixedly attached, the movable arm constructed and arranged to move the drape relative to the insert.

2. The system of claim 1 further comprising a movable gate that is adapted to be moved from a closed position in which it prevents tubes from moving from the conveyor into the insert and an open position in which it allows tubes to move from the conveyor into the insert.

3. The system of claim 2 further comprising a controller that controls operation of the lift system, the clamps, the pivot system and the gate.

4. The system of claim 1 further comprising an input conveyor system that is constructed and arranged to move an empty container onto the lift system.

5. The system of claim 4 further comprising an output conveyor system that is constructed and arranged to move a full container away from the lift system.

6. The system of claim 5 wherein the pivot system is constructed and arranged to oscillate the engaged insert holder and container together about the pivot axis.

7. The system of claim 6 further comprising a controller that controls the oscillation.

8. The system of claim 7 wherein the controller also controls the clamps, the lift system, the input conveyor system, the output conveyor system, and the movable arm.

9. A system for filling a box that has a bottom with relatively long thin tubes that are delivered on a tube conveyor, wherein the tubes lie across the conveyor such that their longitudinal axes are transverse to a direction of motion of the conveyor, the system comprising:

a generally rectangular tubular-shaped sheet-metal insert with an open top and an open bottom, the insert sized and shaped to fit into the box and defining a width that is slightly larger than the length of the tubes;

an insert holder that is adapted to engage the insert to hold the insert in place;

a lift system that moves the box between an engaged position in which the box is located over the insert and a disengaged position in which the box is free from the insert;

one or more movable clamps adapted to be moved between an engaged position in which they hold the box in position relative to the insert and a disengaged position in which the box can be disengaged from the insert;

a pivot system that pivots the engaged insert holder and box about a pivot axis that is generally parallel to the longitudinal axes of the tubes, wherein the pivot system is constructed and arranged to oscillate the insert holder about the pivot axis, and wherein the pivot system holds the box such that its bottom is angled from horizontal as it begins being filled with tubes, and incrementally pivots the box more upright, with its bottom closer and closer to horizontal, as the box is filled;

a flexible drape wherein the drape is overlying and in contact with the tubes at least in part while they are on the conveyor, and at least in part while they are in the insert, to help keep the tubes aligned as they fill from the conveyor and across the width of, and into, the insert;

a movable arm to which the drape is fixedly attached, the movable arm constructed and arranged to move the drape relative to the insert;

a movable gate that is adapted to be moved from a closed position in which it prevents tubes from moving from the conveyor into the insert and an open position in which it allows tubes to move from the conveyor into the insert;

an input conveyor system that is constructed and arranged to move an empty box onto the lift system;

an output conveyor system that is constructed and arranged to move a full box away from the lift system; and a controller that controls operation of the lift system, the clamps, the oscillation of the pivot system, the movable arm, the gate, the input conveyor system and the output conveyor system.

* * * * *